US010791411B2

(12) United States Patent
Wang et al.

(10) Patent No.: US 10,791,411 B2
(45) Date of Patent: Sep. 29, 2020

(54) ENABLING A USER TO OBTAIN A SUITABLE HEAD-RELATED TRANSFER FUNCTION PROFILE

(71) Applicant: QUALCOMM Incorporated, San Diego, CA (US)

(72) Inventors: Dongmei Wang, San Diego, CA (US); Lae-Hoon Kim, San Diego, CA (US); Erik Visser, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/244,875

(22) Filed: Jan. 10, 2019

(65) Prior Publication Data

US 2020/0228915 A1 Jul. 16, 2020

(51) Int. Cl.
*H04R 5/033* (2006.01)
*H04S 7/00* (2006.01)

(52) U.S. Cl.
CPC ..... *H04S 7/306* (2013.01); *H04R 5/033* (2013.01); *H04R 2420/07* (2013.01); *H04S 2420/01* (2013.01)

(58) Field of Classification Search
CPC ..... H04S 7/306; H04S 2420/01; H04R 5/033; H04R 2420/07
USPC ..... 381/1, 17, 26, 303, 309
See application file for complete search history.

(56) References Cited

U.S. PATENT DOCUMENTS 6,223,090 B1 * 4/2001 Brungart ..... H04R 29/001 381/17
9,955,279 B2 * 4/2018 Riggs ..... G06F 3/012
10,387,437 B2 * 8/2019 Nowak-Przygodzki ..... G06F 16/24578
2003/0138107 A1 * 7/2003 Jin ..... A61B 5/1077 381/17
2006/0177078 A1 * 8/2006 Chanda ..... H04S 1/005 381/309
2014/0198918 A1 * 7/2014 Li ..... H04S 7/30 381/26
2015/0373477 A1 * 12/2015 Norris ..... H04R 5/04 381/303
2017/0245081 A1 8/2017 Lyren et al.
2017/0332186 A1 11/2017 Riggs et al.

OTHER PUBLICATIONS

International Search Report and Written Opinion—PCT/US2019/068093—ISAEPO—dated Mar. 31, 2020.

* cited by examiner

*Primary Examiner* — Vivian C Chin
*Assistant Examiner* — Friedrich Fahnert
(74) *Attorney, Agent, or Firm* — Moore Intellectual Property Law, PLLC

(57) ABSTRACT

Methods, systems, computer-readable media, and apparatuses for HRTF profile selection are presented. In one example, a device prompts a user to follow a simple procedure to obtain measurements that are matched to a suitable high-resolution HRTF profile.

20 Claims, 11 Drawing Sheets

ENABLING A USER TO OBTAIN A SUITABLE HEAD-RELATED TRANSFER FUNCTION PROFILE

FIELD OF THE DISCLOSURE

Aspects of the disclosure relate to audio signal processing.

BACKGROUND

The perception of a sound by a listener is influenced by three different elements: 1) the source of the sound, 2) the environment between the source and the user; and 3) the user herself. More specifically, physical aspects of the listener, such as the shape of the head, outer ear, and torso, act as a personalized filter that affect the perceived sound in a unique manner.

BRIEF SUMMARY

A method of obtaining a head-related transfer function (HRTF) according to a general configuration includes obtaining a series of measurements, wherein obtaining each of the series of measurements includes driving a loudspeaker to emit an excitation signal and recording information that is based on the emitted excitation signal as received via each of a pair of microphones. The method also includes submitting, to a classifier, a query that is based on the recorded information from each of the series of measurements and receiving, in response to the query, at least one of (A) information identifying a corresponding one of a plurality of different HRTF profiles and (B) at least part of the corresponding HRTF profile. Computer-readable storage media comprising code which, when executed by at least one processor, causes the at least one processor to perform such a method are also disclosed.

An apparatus for obtaining a head-related transfer function (HRTF) according to a general configuration includes a memory configured to store information and a processor. The processor is coupled to the memory and configured to obtain a series of measurements, wherein obtaining each of the series of measurements includes driving a loudspeaker to emit an excitation signal and recording information that is based on the emitted excitation signal as received via each of a pair of microphones. The processor is also configured to submit, to a classifier, a query that is based on the recorded information from each of the series of measurements and to receive, in response to the query, at least one of (A) information identifying a corresponding one of a plurality of different HRTF profiles and (B) at least part of the corresponding HRTF profile.

BRIEF DESCRIPTION OF THE DRAWINGS

Aspects of the disclosure are illustrated by way of example. In the accompanying figures, like reference numbers indicate similar elements.

DETAILED DESCRIPTION

Figure 1:
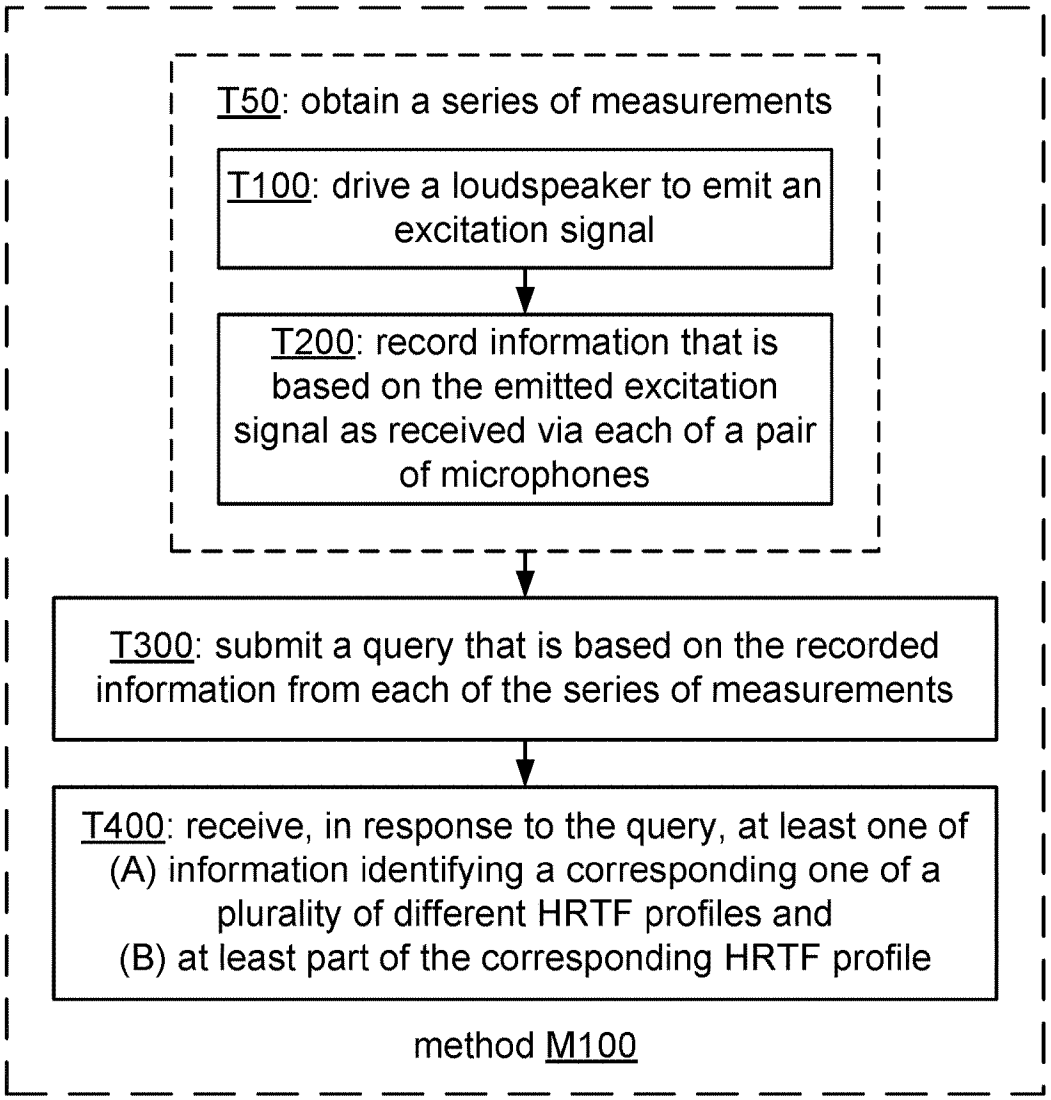
FIG. 1 shows a flowchart of a method M100 according to a general configuration.

The process of creating an immersive 3D audio experience may include applying a head-related transfer function (HRTF) to a recorded or generated sound in order to convey a impression to the user that the sound is arriving from a desired source direction. The HRTF is selected, according to the desired direction, from a profile that may include many different source directions (e.g., up to one thousand or more for a high-resolution profile).

Generation of a high-resolution HRTF profile is exceedingly cumbersome, as such a process typically includes measuring a response, at each ear of the subject, to acoustic excitations emitted serially from each of one thousand or more different source directions. During this process, which is typically performed in an anechoic chamber and using a precisely movable array of loudspeakers, the subject's head must remain essentially motionless. For such reasons, it is impractical to obtain a high-resolution HRTF profile for every consumer, and consumer devices typically use a default HRTF profile instead to obtain a result that may be at least acceptable for a majority of users. Such a default profile may be generated from a model of a human head (e.g., a spherical model) or may be based on acoustic measurements using a synthetic head model such as a KEMAR (Knowles Electronics Mannequin for Acoustic Research) (GRAS Sound and Vibration A/S, Holte, DK).

Several databases of high-resolution HRTF profiles that have been measured for a variety of different individuals are available for public use. Examples include the CIPIC (Center for Image Processing and Integrated Computing) HRTF Database (University of California, Davis, Calif.), the ARI (Acoustics Research Institute) HRTF Database (Austrian Academy of Sciences, Vienna, AT), the LISTEN HRTF database (Institut de Recherche et de Coordination Acoustique/Musique (Ircam), Paris, FR), and the ITA (Institute of Technical Acoustics) HRTF-database (Rheinisch-Westfalische Technische Hochschule Aachen (RWTH Aachen University), Aachen, DE). Unfortunately, it has not yet been possible to readily determine which among the profiles of such a database is a match for a particular user's own body characteristics. Accordingly, it has not been possible to directly apply such high-resolution HRTF profiles to the problem of improving the experience of an individual in a virtual or augmented auditory environment.

The HRTF is typically measured in the time domain as the head-related impulse response (HRIR), and an HRTF profile typically has the form of two three-dimensional arrays (one for the left side, and one for the right side) having the dimensions of azimuth angle, elevation angle, and time. In formally correct terms, the HRTF is the Fourier transform of the HRIR. Colloquially, however, the term 'HRTF' is used to indicate either or both of the frequency-domain and time-domain forms, and in this description and the claims that follow, the term 'HRTF' used to indicate either or both of a frequency-domain form and a time-domain form (i.e., HRIR) unless otherwise indicated. Formats for storing spatially oriented acoustic data, such as HRTFs and HRIRs, include the SOFA format (e.g., as standardized by the Audio Engineering Society (AES, New York, N.Y.) as AES69-2015).

Some progress has been made on understanding the correlation between physical characteristics of an individual and the individual's HRTF. The actual use of such knowledge to select a suitable HRTF profile from a database, however, currently requires a detailed surface map of at least the user's ears and is not practical for general use.

Methods, apparatus, and systems as disclosed herein include implementations that may be used by a user to readily obtain a high-resolution HRTF profile that is a good match to the user's own body characteristics (e.g., better than a default profile). Such techniques may be used to enable a user to obtain a better and more personalized 3D audio experience.

Several illustrative embodiments will now be described with respect to the accompanying drawings, which form a part hereof. While particular embodiments, in which one or more aspects of the disclosure may be implemented, are described below, other embodiments may be used and various modifications may be made without departing from the scope of the disclosure or the spirit of the appended claims.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Unless expressly limited by its context, the term "recording" is used to indicate any of its ordinary meanings, such as storing (e.g., to an array of storage elements). Unless expressly limited by its context, the term "determining" is used to indicate any of its ordinary meanings, such as deciding, establishing, concluding, calculating, selecting, and/or evaluating. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least." Unless otherwise indicated, the terms "at least one of A, B, and C," "one or more of A, B, and C," "at least one among A, B, and C," and "one or more among A, B, and C" indicate "A and/or B and/or C." Unless otherwise indicated, the terms "each of A, B, and C" and "each among A, B, and C" indicate "A and B and C."

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. A "task" having multiple subtasks is also a method. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one.

FIG. 1 shows a flowchart of a method M100 according to a general configuration that includes tasks T50, T100, T200, T300, and T400. Task T50 obtains a series of measurements and includes subtasks T100 and T200. For each of the series of measurements, task T100 causes a loudspeaker to emit an excitation signal. For each of the series of measurements, task T200 records information that is based on the emitted excitation signal as received via each of a pair of microphones. Task T300 submits, to a classifier, a query that is based on the recorded information from each of the series of measurements, and task T400 receives, in response to the query, at least one of (A) information identifying a corresponding one of a plurality of different HRTF profiles and (B) at least part of the corresponding HRTF profile.

Figure 2:
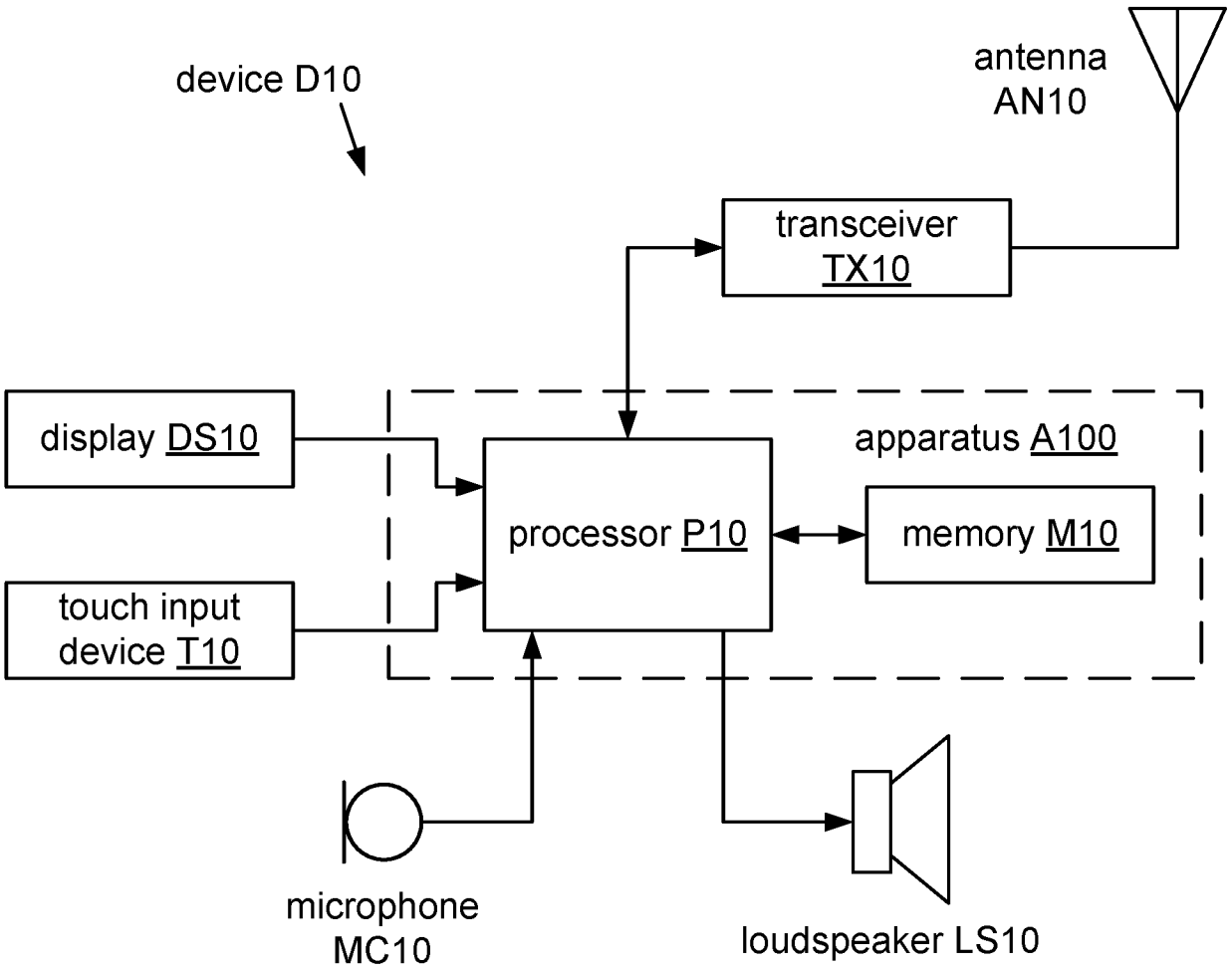
FIG. 2 shows a block diagram of a device D10 that includes an apparatus A100 according to a general configuration.
Figure 3B:
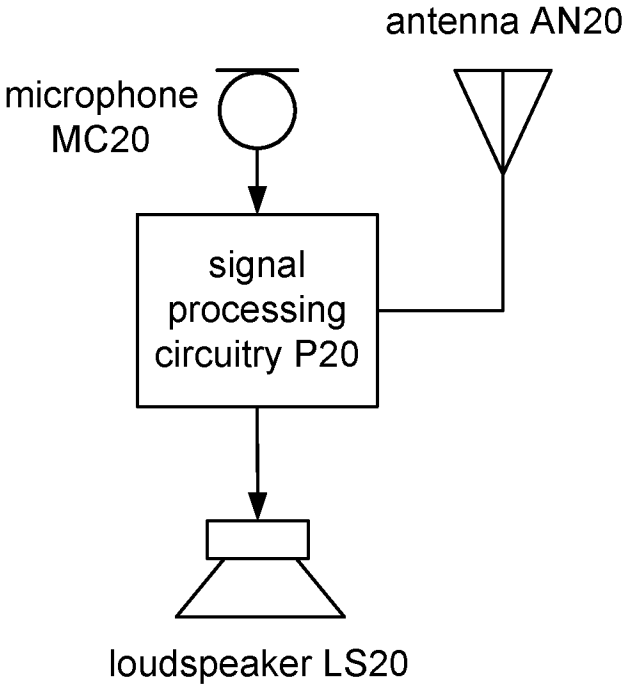
FIG. 3B shows a block diagram of a hearable.
Figure 3A:
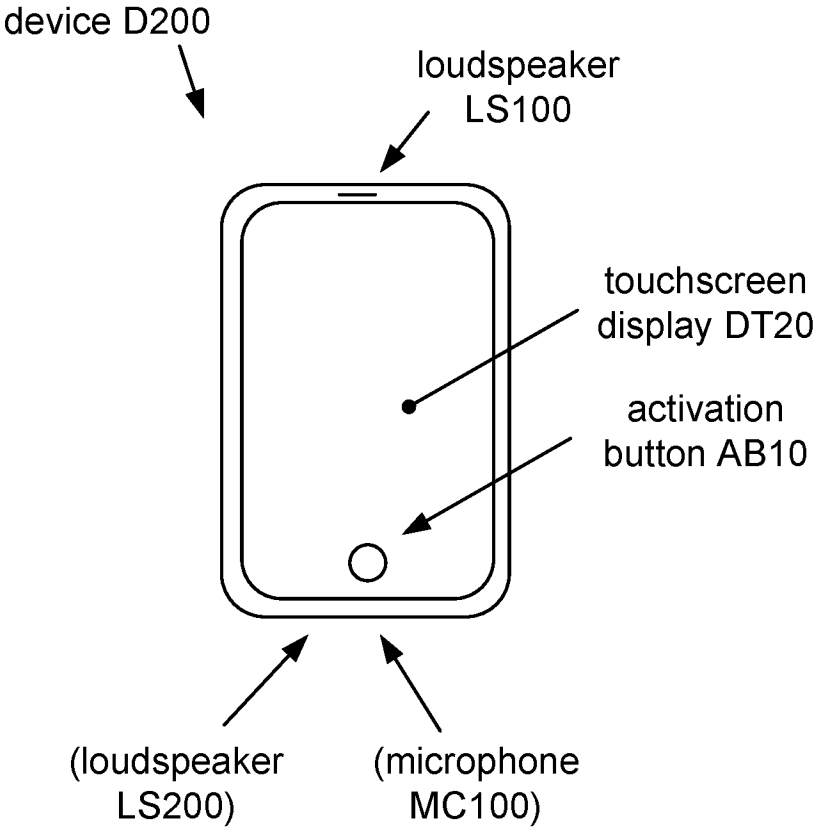
FIG. 3A shows a block diagram of an implementation D200 of device D100 as a smartphone.

In one example, a user launches software (e.g., an application or "app") on a mobile device (e.g., a smartphone or tablet) that causes the device to perform method M100. FIG. 2 shows a block diagram of a device D10 that includes an apparatus A100 according to a general configuration. Apparatus A100 includes a memory M10 configured to store information and a processor P10 that is coupled to memory M10 and configured to perform the operations of method M100. Device D100 also includes a loudspeaker LS10 that is configured and arranged to emit the excitation signal for each of the series of measurements, a microphone MC10 that is configured to produce a microphone output signal in response to acoustic vibrations, a display DS10 configured and arranged to display elements of a graphical user interface (GUI) to a user of the device, and a touch input device T10 (e.g., a keypad and/or touchscreen) configured and arranged to receive input from a user. In this example, device D100 also includes a transceiver TX10 configured and arranged to transmit the query and receive the corresponding response wirelessly via antenna AN10. FIG. 3A shows a block diagram of an implementation D200 of device D100 as a smartphone that includes an instance LS100 of loudspeaker LS10; instances LS200 and MC100 of loudspeaker LS10 and microphone MC10, respectively (not visible); a touchscreen display DT20 that is an implementation of both display DS10 and touch input device T10, and an activation button AB 10 that is part of touch input device T10 as implemented in device D200.

Device D10 (e.g., device D100 or D200) may be configured to perform an implementation of method M100 in conjunction with one or more hearable devices or "hearables" that include microphones worn at each ear of the user. Hearables (also known as "smart headphones," "smart earphones," "smart earbuds," or "smart earpieces") are becoming increasingly popular. Such devices, which are designed to be worn over the ear or in the ear, have been used for multiple purposes, including wireless transmission and fitness tracking. As shown in FIG. 3B, the hardware architecture of a hearable typically includes a loudspeaker LS20 to reproduce sound to a user's ear; a microphone MC20 to sense the user's voice and/or ambient sound; and signal processing circuitry P20 to communicate with another device (e.g., a smartphone) via an antenna AN20. A hearable may also include one or more sensors: for example, to track heart rate, to track physical activity (e.g., body motion), or to detect proximity of the user (e.g., to indicate that the hearable is being worn) and/or of another object (e.g., to detect the user's finger for touch actuation of an operation).

Figure 4:
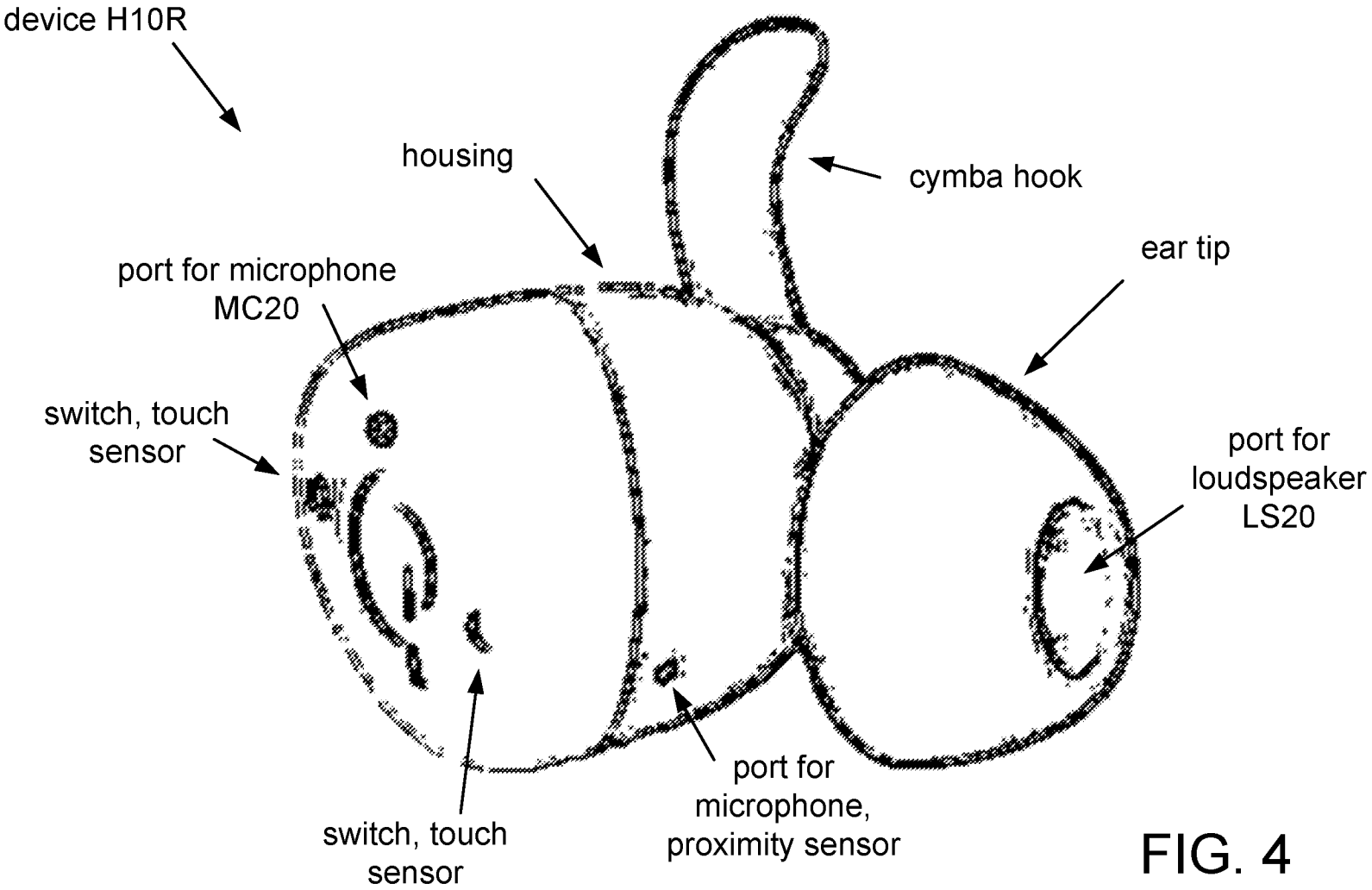
FIG. 4 shows a picture of an implementation H100R of device H10 as a hearable.

FIG. 4 shows a picture of an implementation H10R of a hearable configured to be worn at a right ear of a user. Such a device H10R may include any among a hook or wing to secure the device in the cymba and/or pinna of the ear; an ear tip to provide passive acoustic isolation; one or more switches and/or touch sensors for user control; one or more additional microphones (e.g., to sense an acoustic error signal); and one or more proximity sensors (e.g., to detect that the device is being worn). Implementations of method M100 may also be practiced with other devices that include a microphone worn at each ear of a user (e.g., earbuds, headsets, head-mounted displays).

Figure 5:
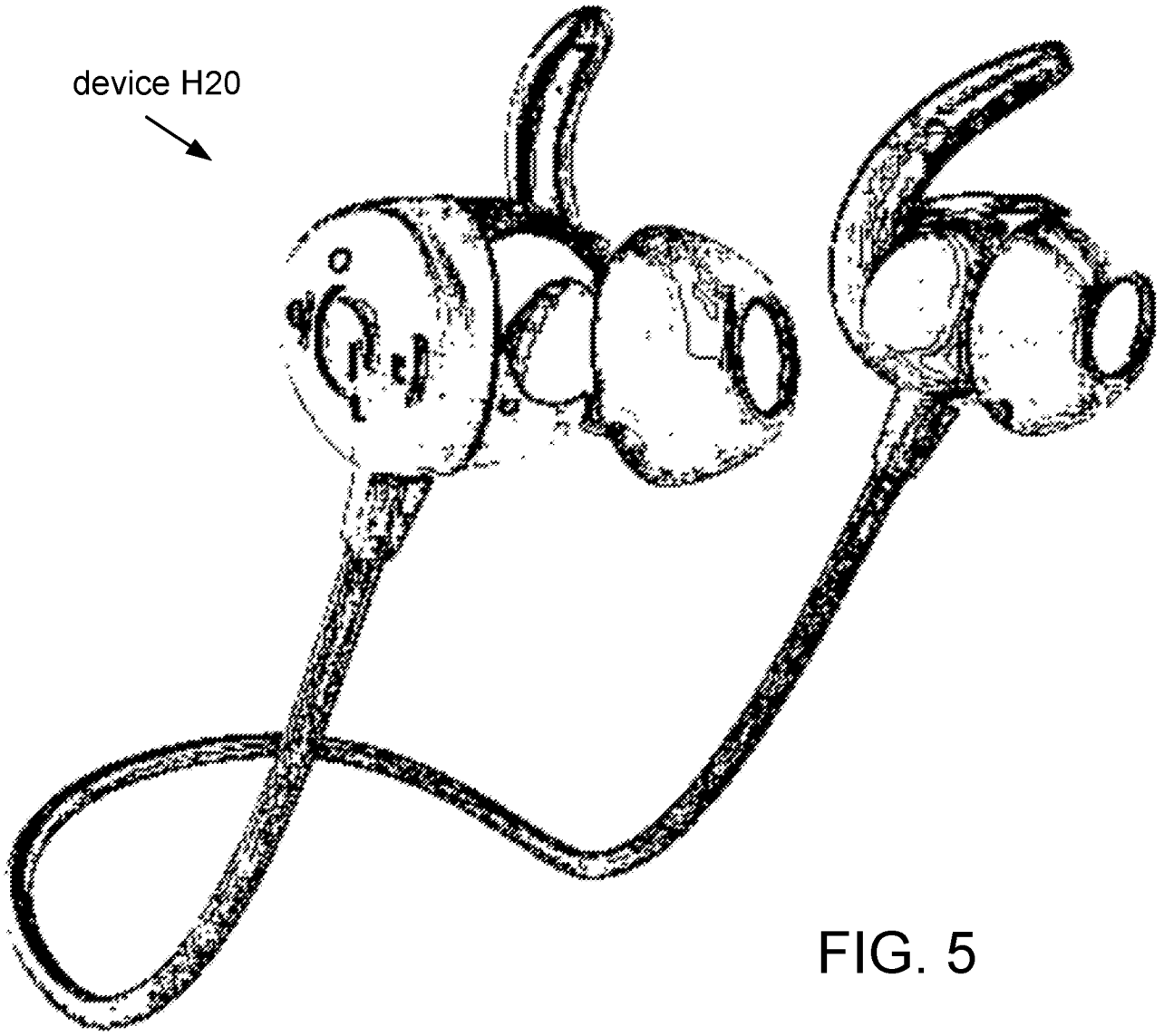
FIG. 5 shows a picture of an implementation H200 of device H10 as a hearable configured to be worn at both ears of a user.

A hearable worn at one ear of a user may be configured to communicate audio and/or control signals to a hearable worn at the user's other ear wirelessly: for example, using a version of the Bluetooth® protocol (as specified by the Bluetooth Special Interest Group (SIG), Kirkland, Wash.) and/or by near-field magnetic induction (NFMI). Alternatively, a hearable worn at one ear of a user may be configured to communicate audio and/or control signals to a hearable worn at the user's other ear conductively (e.g., by wire). FIG. 5 shows a picture of an implementation H20 of a hearable configured to be worn at both ears of a user that includes a corresponding instance of microphone MC20 and loudspeaker LS20 at each ear.

In one example, a device performing an implementation of method M100 (e.g., a smartphone) may emit the excitation signal for each of the series of measurements so that the emitted signal is received via a microphone at each of the user's ears (e.g., in a hearable). Information from the received signal is transmitted back to the device (e.g., over a Bluetooth, visible-light, infrared-light, and/or other personal area network (PAN) connection), which formulates a query from the information and submits it to a remote entity for classification (e.g., to a cloud-based application over a cellular data, Wi-Fi, and/or other local area network (LAN) or wide area network (WAN) connection).

For each of a series of measurements, task T100 causes a loudspeaker to emit an excitation signal. It may be desirable for the excitation signal to include a wide range of audio frequencies (e.g., from 100, 300, 500, or 1000 Hz to 3, 5, 10, or 15 kHz or more). It may be desirable for the excitation signal to have a relatively short time duration (e.g., less than ten, five, two, or one seconds) to reduce effects of movement of the emitting device by the user during each emission. Alternatively or additionally, it may be desirable for the excitation signal to have an impulse-like time duration (e.g., less than one, 0.5, 0.25, 0.1, 0.05, 0.03, 0.01, or 0.005 seconds) to facilitate separation of the direct-path received signal from room reflections. Task T100 may include driving the loudspeaker (e.g., via an audio amplifier of the device) to emit the excitation signal by a chirp, click, swept sine, white noise, or pseudo-random binary sequence (e.g., a maximal length sequence (MFS), a pair of complementary Golay codes).

It may be desirable to monitor and/or record an orientation of the emitting device during emission of an excitation signal. For example, it may be desirable to maintain the emitting device in a relatively constant position during emission of an excitation signal. Signals indicating orientation and/or movement of the emitting device may be obtained from an inertial measurement unit (IMU) of the device, which may include one or more accelerometers, gyroscopes, and/or magnetometers. Device D10 may be configured, for example, to discard information based on an emitted excitation signal in response to determining that a movement and/or a change in orientation of the device during the emission exceeded (alternatively, was not less than) a threshold value.

Figure 6:
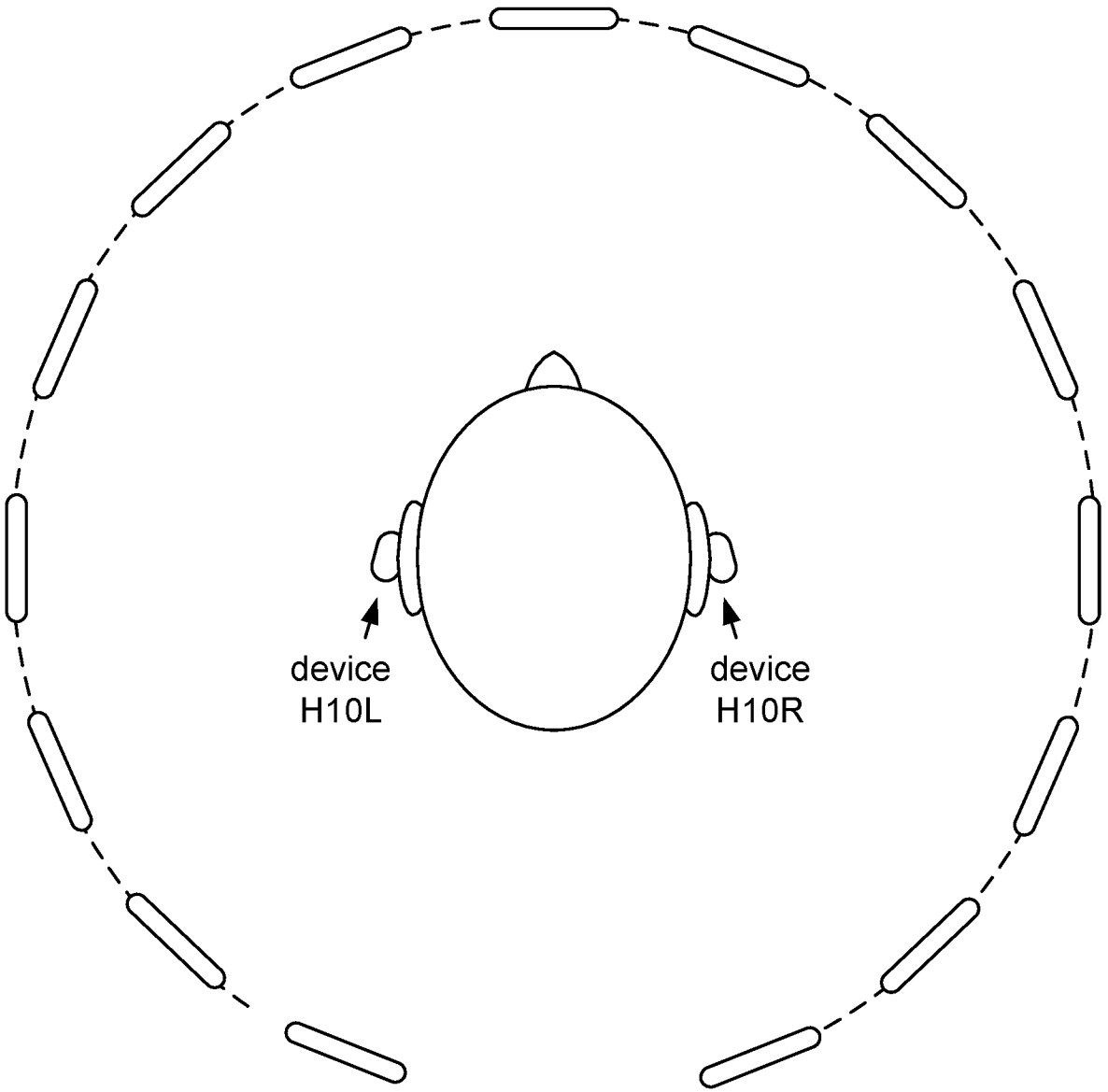
FIG. 6 shows examples of locations of a device at different corresponding azimuth angles.
Figure 7:
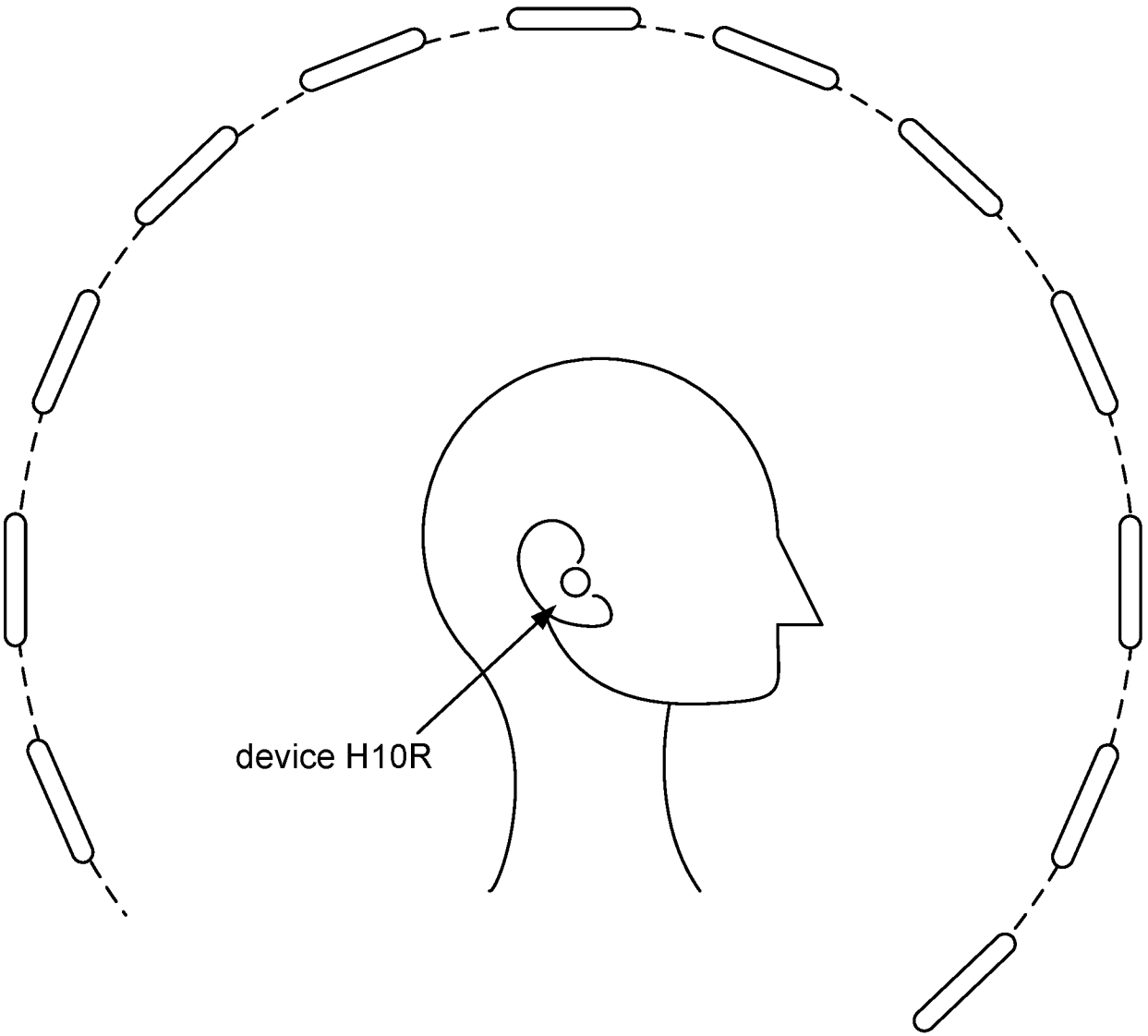
FIG. 7 shows examples of locations of a device at different corresponding elevation angles.
Figure 8:
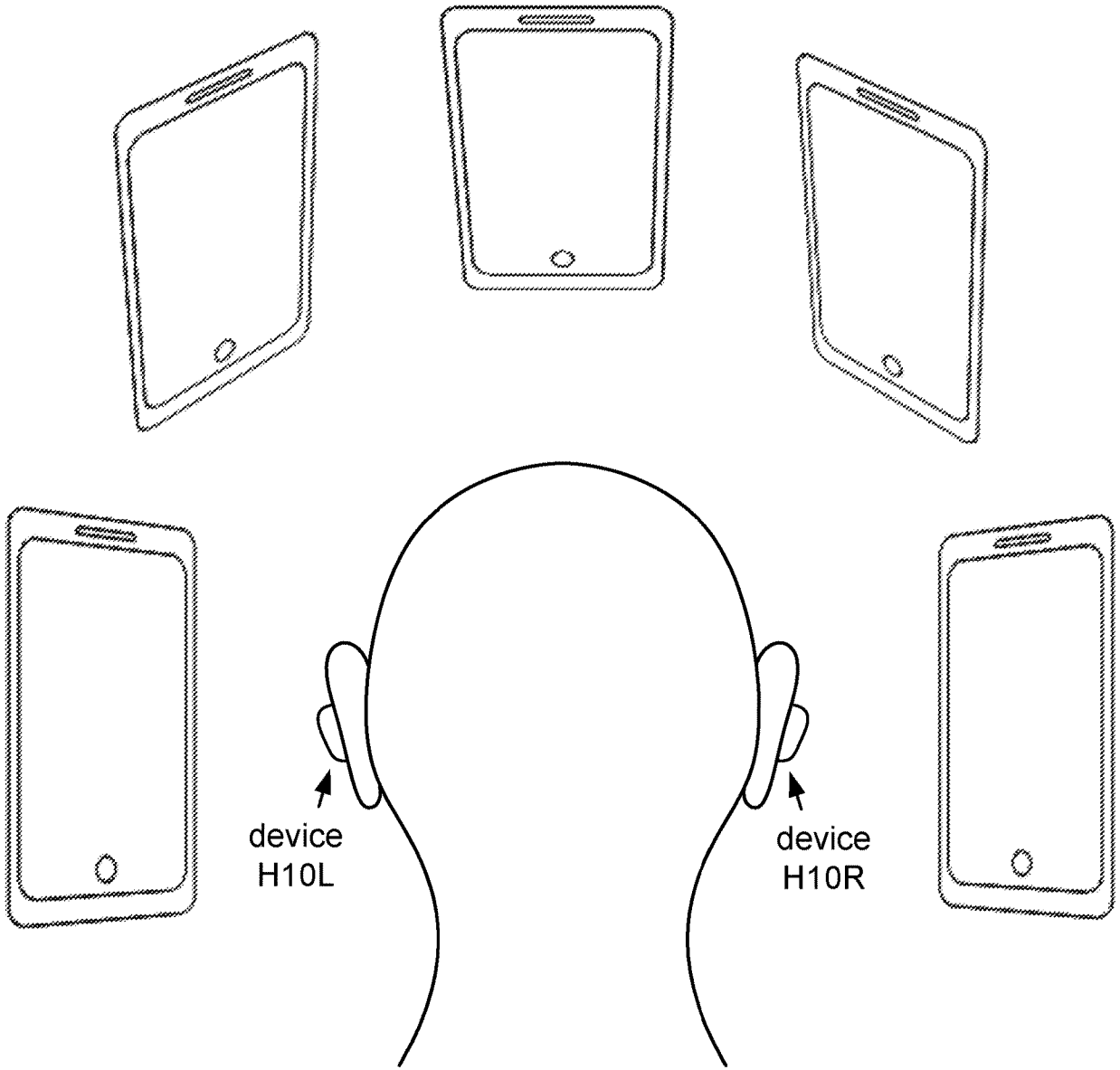
FIG. 8 shows examples of a device being oriented toward a center of the user's head at different locations.

The number of measurements in the series may be as little as, for example, four, eight, or ten. Especially when the number of measurements is so low, sampling over a diversity of source positions may be important to the quality of the resulting classification. A device performing an implementation of method M100 may prompt the user (e.g., via a graphical and/or auditory user interface) to hold the device, for each of the series of measurements, at a different locations relative to the user's head. The device may encourage diversity among source locations by prompting the user to move the device to a different location for each measurement. FIG. 6 shows examples of different locations of such a device, each location corresponding to a different azimuth angle with respect to a reference direction (e.g., the direction in which the user is facing). FIG. 7 shows examples of different locations of such a device, each location corresponding to a different elevation angle with respect to a reference direction (e.g., the direction in which the user is facing). It may be desirable for the user to hold the device at each of the different locations at a relatively constant distance from a center of the user's head (e.g., at arm's length) and/or with the device being oriented toward a center of the user's head (e.g., as shown in FIG. 8).

A device performing an implementation of method M100 may prompt the user to hold the device at different source locations at the left side of the user's head for each measurement of one part of the series of measurements and at different source locations at the right side of the user's head for each measurement of another part of the series. The device may prompt the user to hold the device above the user's head for some measurements in the series and below the user's head for other measurements in the series. The device may prompt the user to hold the device at specific source locations for different measurements of the series. The user interface may be configured to display the video image of a front-facing camera of the device to assist the user in orienting the device to emit the excitation signal in a direction toward the center of the user's head (e.g., as shown in FIG. 8). The user interface may be configured to produce an auditory indication (e.g., a countdown) before each emission and/or to initiate each emission in response to a voice command of the user.

A device performing an implementation of method M100 may be configured to evaluate diversity among source locations based on output of an IMU of the device: for example, by tracking movement among the emission locations and/or by comparing the orientation of the device during each of the emissions. Alternatively or additionally, such a device may be configured to evaluate diversity among source locations by comparing azimuth and/or elevation angles indicated by the various emissions as recorded. Diversity among azimuth angles may be estimated, for example, by a range among the absolute differences, for each of the recorded emissions, between the time of arrival of the emission at the user's left ear (e.g., as indicated by the first peak of the recorded emission) and the time of arrival of the emission at the user's right ear. Diversity among elevation angles may be estimated, for example, by a range among relative sound levels, for each of the recorded emissions, at frequencies around 7-8 kHz and possibly around 12 kHz.

Figure 9:
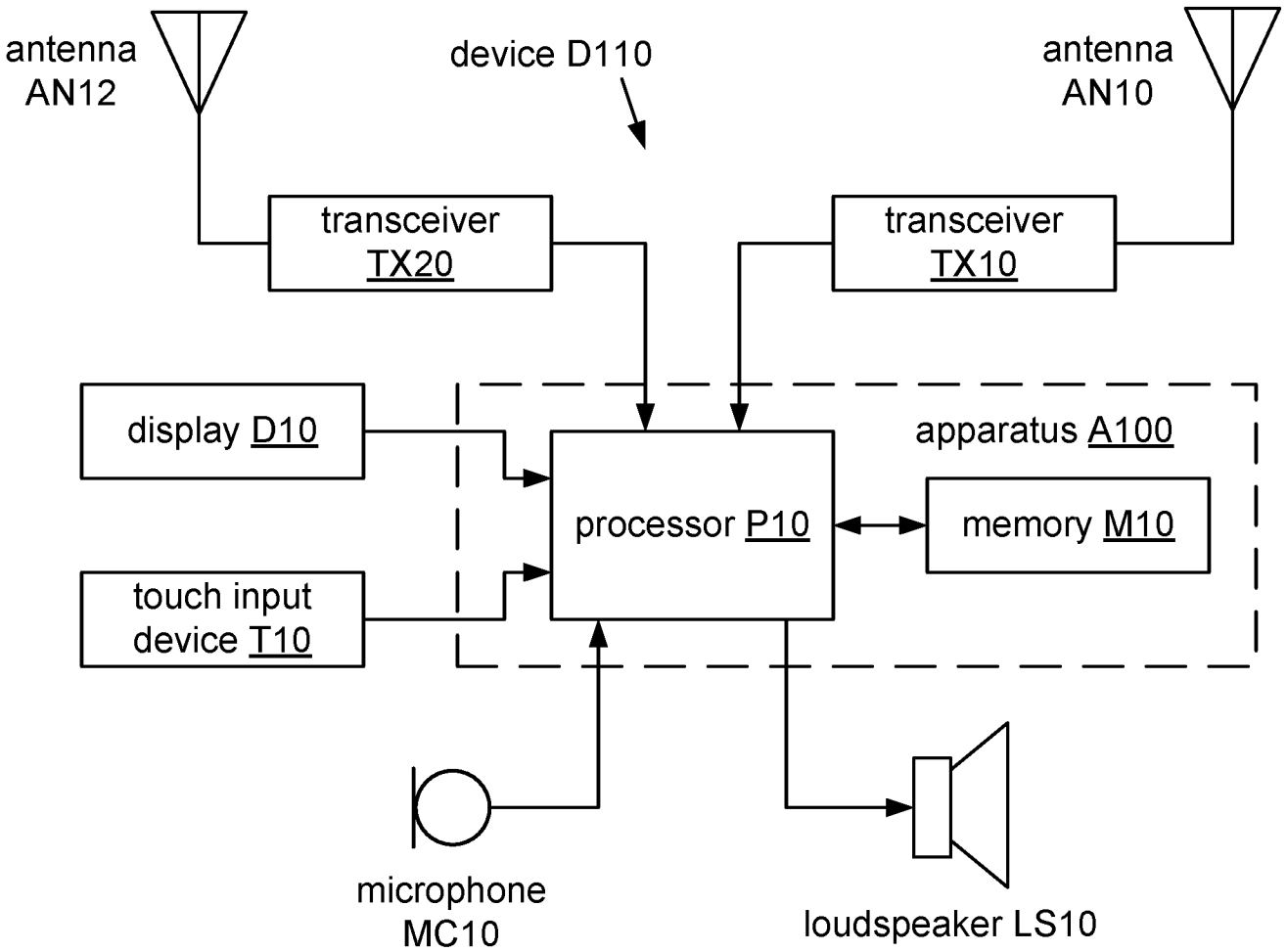
FIG. 9 shows a block diagram of an implementation D110 of device D100 that includes a second transceiver TX20.

For each of the series of measurements, task T200 records information that is based on the emitted excitation signal as received via each of a pair of microphones (e.g., a microphone worn at the user's left ear and a microphone worn at the user's right ear). Each microphone may be part of a hearable that is configured to transmit information based on the excitation signal as received via the microphone. The hearable may be configured to transmit the information to the emitting device over a wireless link, such as a Bluetooth or light-based (e.g., visible or infrared) data connection. Alternatively, each of a pair of hearables may be configured to independently transmit information that is based on the excitation signal as received via its microphone to the emitting device (e.g., over such a wireless link). More commonly, one of a pair of hearables is configured to transmit such information to the other hearable over one wireless link (e.g., an NFMI link), and the other hearable is configured to transmit the information, and the information corresponding to its own microphone, to the emitting device over another wireless link (e.g., a Bluetooth or light-based link). FIG. 9 shows a block diagram of an implementation D110 of device D100 that includes a second transceiver TX20 configured to support such a wireless link with one or more hearables via an antenna AN12.

Such transmission of measurement information to the emitting device may occur during the emission, after each emission, after the series of emissions, or after a portion of the series of emissions. For example, transmission to the emitting device may be performed after a sequence of emissions from locations at one side of the user's head, and again after a sequence of emissions from locations at the other side of the user's head.

Task T200 may be configured to record the information to a memory of the emitting device (e.g., memory M10 of device D100). The information recorded by task T200 may be the excitation signals, as received via the microphones, in a raw or compressed form. Alternatively, the received signals may be processed to obtain the information (at the hearable before transmission and/or at the emitting device after reception). Such processing may include one or more operations to remove unnecessary and/or distracting information, such as truncation (e.g., to remove room reflections) and/or filtering (e.g., to reduce effects of stationary noise and/or the frequency responses of the particular loudspeaker and/or microphones). Such processing may include free-field compensation using, for example, a signal obtained by prompting the user (e.g., by the emitting device) to hold one or more of the hearables toward the emitting device, rather than wearing it, and recording an excitation signal as received via the microphone in this position.

Figure 10B:
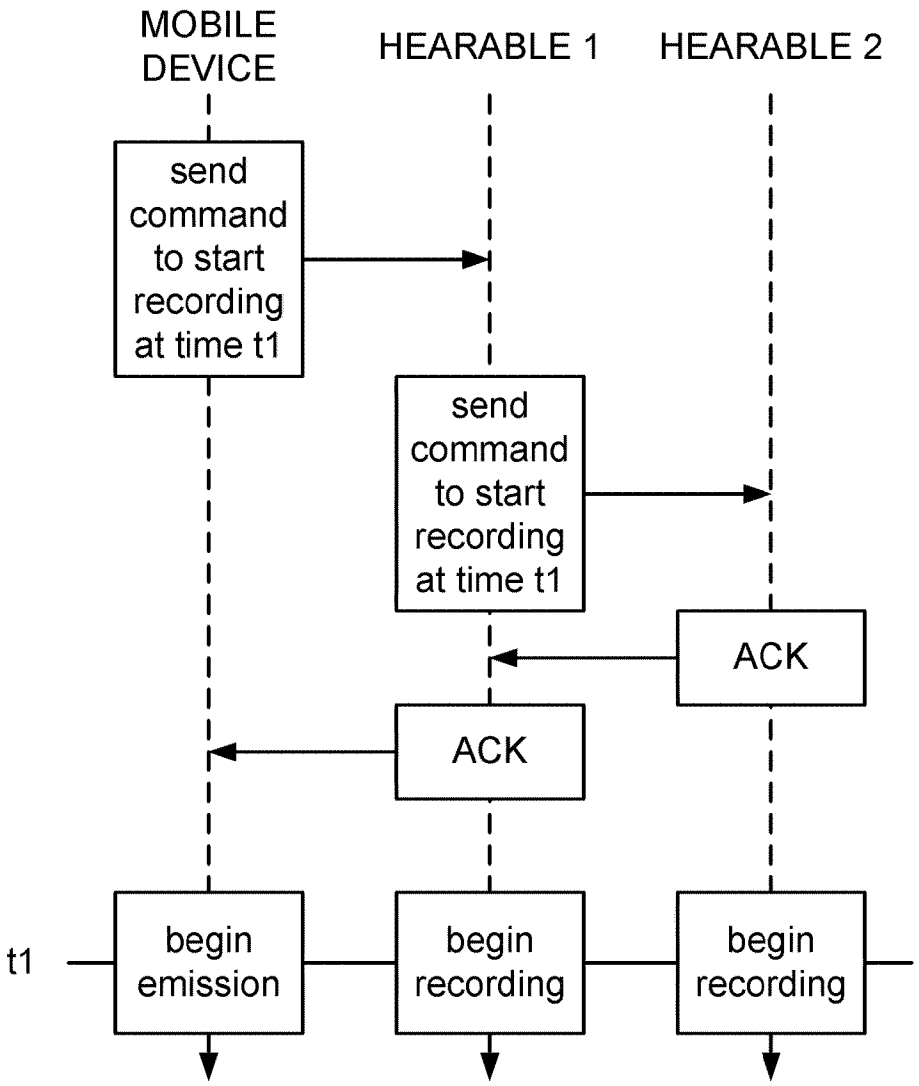
FIGS. 10A and 10B show examples of control sequences.
Figure 10A:
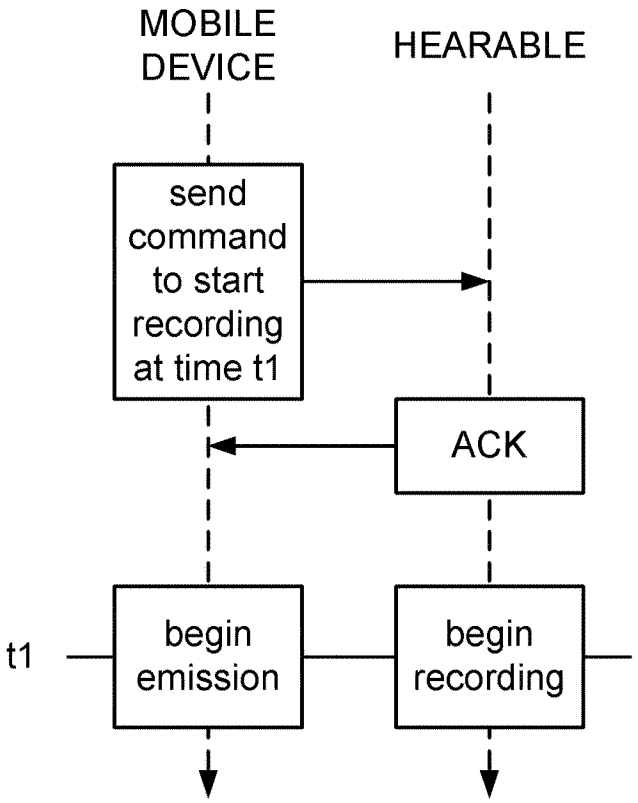

Recording of the emitted excitation signal as received via the pair of microphones may be performed (e.g., by a hearable) in response to a command from the emitting device and/or according to a clock that is synchronized to a clock of the emitting device. A device performing an implementation of method M100 may be configured to transmit control signals to the hearable over, for example, a Bluetooth, visible-light, infrared-light, and/or other wireless PAN connection. Control and data signals may be carried between the emitting device and the hearable via the same wireless link or by different wireless links. FIG. 10A shows an example of a control sequence in which the emitting device commands the hearable to start recording at a time t1, the hearable acknowledges the command, and emission and recording begin at the time t1.

A device performing an implementation of method M100 may be configured to transmit control signals to each of a pair of hearables. Alternatively, one of the hearables may be configured to forward command signals to and receive corresponding data from the other hearable (e.g., over an NFMI link). FIG. 10B shows an example of a control sequence in which the emitting device commands a first hearable to start recording at a time t1, and the first hearable forwards the command to the second hearable. The second hearable acknowledges the command to the first hearable; in response, the first hearable acknowledges the command to the emitting device, and emission and recording begin at the scheduled time t1.

A device performing an implementation of method M100 may be configured to indicate a confidence level in a measurement and/or in a series of measurements (e.g., by displaying a power bar on a display of the device). The confidence level may be based on, for example, the number of measurements performed (e.g., the current length of the series), a distribution of differences in estimated azimuth angle and/or estimated elevation angle among the measurements, an ambient noise level during the measurements, etc.

Task T300 submits, to a classifier, a query that is based on the recorded information from each of the series of measurements, and task T400 receives, in response to the query, at least one of (A) information identifying a corresponding one of a plurality of different HRTF profiles and (B) at least part of the corresponding HRTF profile. In one example, a device performing an implementation of method M100 is configured to formulate the query as a concatenation of the recorded information. The device may be configured to transmit the query (e.g., via a cellular data, Wi-Fi, and/or other local area network (LAN) or wide area network (WAN) connection) to a corresponding application in the cloud for matching.

In one example, the classifier is a cloud-based matching application that includes a trained deep neural network (e.g., a convolutional neural network or "CNN") which has been trained on partial profiles selected from an HRTF database. In one example, the classifier includes a CNN having six layers: a first convolutional layer, a first pooling layer, a second convolutional layer, a second pooling layer, a first fully connected layer, and a second fully connected layer, with each node in the output layer corresponding to a different subject in the HRTF database. Training of the neural network may be directed using a loss function (e.g., cross-entropy) on the output layer.

The neural network may be trained on one or more databases of HRTF profiles of different subjects as measured at different source positions. The CIPIC database, for example, contains HRTF profiles of 45 different subjects (HRIRs sampled at 44.1 kHz and each having a length of 200 samples), each measured at 1250 source positions (25 different azimuths and 50 different elevations). Training of the neural network may include randomizing the HRTFs or HRIRs by source position, and dividing the randomized set into a training set and a testing set (e.g., 1000 source positions for training and 250 for testing). The source directions of the training data may be selected at random, and/or the range of source directions of the training data may be limited to a particular frontal range to anticipate user behavior.

The training data may be randomized in various ways to make the matching process more robust to variations among user devices and behaviors. For example, the data may be clipped to exclude high-frequency and/or low-frequency regions to anticipate variation among the microphones of user devices. An HRTF may be randomized for training by adding a small amount of random noise. Additionally or alternatively, the absolute delay of an HRIR pair (the left and right HRIRs for a subject at a particular source position) may be randomized for training while preserving the relative delay among the two responses: for example, by time-shifting a principal portion of each HRIR of the pair (e.g., the 48 samples at the center) by the same small number of samples. In one example, each training input is a concatenation of four HRIR pairs.

Task T400 receives, in response to the query, at least one of (A) information identifying a corresponding one of a plurality of different HRTF profiles and (B) at least part of the corresponding HRTF profile. The classifier may return, for example, a high-resolution HRTF profile which is indicated as a best match to the query, or an index to such a profile. A device performing an implementation of method M100 may be configured to receive the information via the same data link that was used to submit the query and/or via a different LAN or WAN connection.

In one example, task T400 receives a matching HRTF profile, which may then be used by the device (or by another audio rendering device) to generate recorded or virtual sounds for the user according to desired source directions. In another example, task T400 receives an identifier of a matching HRTF profile within the database (e.g., the index number of the matching subject), which may be used to access a copy of the profile (or a desired part of such a copy) from other storage (e.g., from a local copy of the database). Additionally or alternatively, task T400 may be configured to forward the received profile or index to another application or hardware (e.g., an audio rendering device, such as a computer, a media playback device, or a gaming device).

Figure 11:
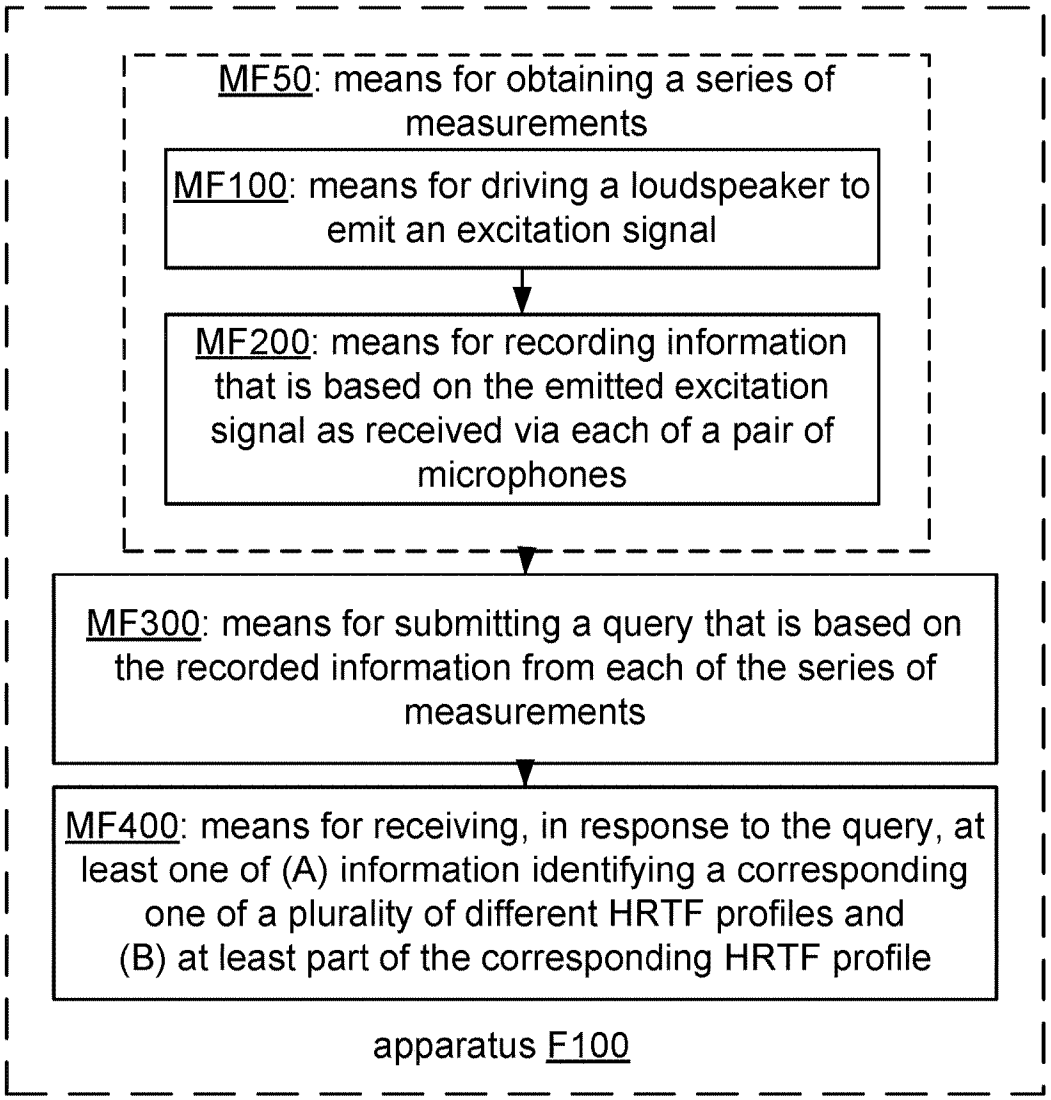
FIG. 11 shows a block diagram of an apparatus F100 according to a general configuration.

FIG. 11 shows a block diagram of an apparatus F100 according to a general configuration that includes means MF50 for obtaining a series of measurements, means MF300 for submitting, to a classifier, a query that is based on the recorded information from each of the series of measurements, and means MF400 for receiving, in response to the query, at least one of (A) information identifying a corresponding one of a plurality of different HRTF profiles and (B) at least part of the corresponding HRTF profile and includes subtasks T100 and T200. Means MF50 includes means MF100 for causing, for each of the series of measurements, a loudspeaker to emit an excitation signal and means MF200 for recording, for each of the series of measurements, information that is based on the emitted excitation signal as received via each of a pair of microphones.

The various elements of an implementation of an apparatus or system as disclosed herein may be embodied in any combination of hardware with software and/or with firmware that is deemed suitable for the intended application. For example, such elements may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of these elements may be implemented within the same array or arrays. Such an array or arrays may be implemented within one or more chips (for example, within a chipset including two or more chips).

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs (digital signal processors), FPGAs (field-programmable gate arrays), ASSPs (application-specific standard products), and ASICs (application-specific integrated circuits). A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to a procedure of an implementation of method M100 (or another method as disclosed with reference to operation of an apparatus or system described herein), such as a task relating to another operation of a device or system in which the processor is embedded (e.g., a voice communications device, such as a smartphone, or a smart speaker). It is also possible for part of a method as disclosed herein to be performed under the control of one or more other processors.

Each of the tasks of the methods disclosed herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media. In one example, a non-transitory computer-readable storage medium comprises code which, when executed by at least one processor, causes the at least one processor to perform a method of obtaining an HRTF as described herein (e.g., with reference to method M100).

The previous description is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A method of obtaining a head-related transfer function (HRTF) for application to an audio rendering device, the method comprising:

obtaining a series of measurements, wherein obtaining each of the series of measurements includes:

driving a loudspeaker to emit an excitation signal; and recording information that is based on the emitted excitation signal as received via each of a pair of microphones;

submitting, to a classifier, a query that is based on the recorded information from each of the series of measurements;

receiving, in response to the query, at least one of (A) information identifying a corresponding one of a plurality of different HRTF profiles and (B) at least part of the corresponding HRTF profile; and applying at least one HRTF selected from the corresponding HRTF profile to the audio rendering device.

2. The method according to claim 1, wherein, for each of the series of measurements, the excitation signal is based on a pseudo-random binary sequence.

3. The method according to claim 1, wherein the obtaining a series of measurements includes issuing a command, for at least one of the series of measurements, to record the emitted excitation signal as received via each of the pair of microphones, and wherein the issuing comprises transmitting the command, via a wireless link, from a first device that includes the loudspeaker to a second device that includes at least one of the pair of microphones.

4. The method according to claim 1, wherein the query includes a concatenation of the recorded information from each of the series of measurements.

5. The method according to claim 1, wherein the method includes recording, for each of the series of measurements, a corresponding orientation of an apparatus that comprises the loudspeaker.

6. The method according to claim 1, wherein the method includes prompting a user of an apparatus that comprises the loudspeaker, between each adjacent pair of the series of measurements, to move the apparatus to a different location.

7. The method according to claim 1, wherein the method includes estimating, for each of the series of measurements, at least one among (A) a corresponding azimuth angle of an apparatus that comprises the loudspeaker and (B) a corresponding elevation angle of the apparatus that comprises the loudspeaker.

8. The method according to claim 1, wherein the recorded information is based on information received, by a first device comprising the loudspeaker and from a second device comprising at least one of the pair of microphones, via a wireless link.

9. The method according to claim 1, wherein the method includes, for each of the series of measurements and at least immediately prior to the driving the loudspeaker, providing, to a user of a device that includes the loudspeaker, a video indication of a relative orientation of the device.

10. An apparatus for obtaining a head-related transfer function (HRTF) for application to an audio rendering device, the apparatus comprising:

means for obtaining a series of measurements, including:

means for driving a loudspeaker to emit an excitation signal; and means for recording information that is based on the emitted excitation signal as received via each of a pair of microphones;

means for submitting, to a classifier, a query that is based on the recorded information from each of the series of measurements;

means for receiving, in response to the query, at least one of (A) information identifying a corresponding one of a plurality of different HRTF profiles and (B) at least part of the corresponding HRTF profile; and means for applying at least one HRTF selected from the corresponding HRTF profile to the audio rendering device.

11. An apparatus for obtaining a head-related transfer function (HRTF) for application to an audio rendering device, the apparatus comprising:

a memory configured to store information; and a processor coupled to the memory and configured to:

obtain a series of measurements, wherein obtaining each of the series of measurements includes:

causing an excitation signal to be emitted from a loudspeaker of the apparatus; and recording, to the memory, information that is based on the emitted excitation signal as received via each of a pair of microphones;

submit a query that is based on the recorded information from each of the series of measurements;

receive, in response to the query, at least one of (A) information identifying a corresponding one of a plurality of different HRTF profiles and (B) at least part of the corresponding HRTF profile; and apply at least one HRTF selected from the corresponding HRTF profile to the audio rendering device.

12. The apparatus according to claim 11, wherein, for each of the series of measurements, the excitation signal is based on a pseudo-random binary sequence.

13. The apparatus according to claim 11, wherein the processor is configured to issue a command, for at least one of the series of measurements, to record the emitted excitation signal as received via each of the pair of microphones, and wherein the processor configured to issue is configured to transmit the command, via a wireless link, from the apparatus to a device that includes at least one of the pair of microphones.

14. The apparatus according to claim 11, wherein the query includes a concatenation of the recorded information from each of the series of measurements.

15. The apparatus according to claim 11, wherein the processor is configured to record, for each of the series of measurements, a corresponding orientation of the apparatus.

16. The apparatus according to claim 11, wherein the processor is configured to prompt a user of the apparatus, between each adjacent pair of the series of measurements, to move the apparatus to a different location.

17. The apparatus according to claim 11, wherein the processor is configured to estimate, for each of the series of measurements, at least one among (A) a corresponding azimuth angle of the apparatus and (B) a corresponding elevation angle of the apparatus.

18. The apparatus according to claim 11, wherein the information recorded to the memory is based on information received by the apparatus, from a device comprising at least one of the pair of microphones, via a wireless link.

19. The apparatus according to claim 11, wherein the processor is configured to provide to a user of the apparatus, for each of the series of measurements and at least immediately prior to causing the excitation signal to be emitted, a video indication of a relative orientation of the apparatus.

20. A non-transitory computer-readable storage medium storing computer-executable instructions, which when executed by one or more processors, cause the one or more processors to execute a method of obtaining a head-related transfer function (HRTF) for application to an audio rendering device, the method comprising:

obtaining a series of measurements, wherein obtaining each of the series of measurements includes:

driving a loudspeaker to emit an excitation signal; and recording information that is based on the emitted excitation signal as received via each of a pair of microphones;

submitting, to a classifier, a query that is based on the recorded information from each of the series of measurements;

receiving, in response to the query, at least one of (A) information identifying a corresponding one of a plurality of different HRTF profiles and (B) at least part of the corresponding HRTF profile; and applying at least one HRTF selected from the corresponding HRTF profile to the audio rendering device.

* * * * *